US009700907B2

(12) United States Patent
Greiner-Perth et al.

(10) Patent No.: US 9,700,907 B2
(45) Date of Patent: Jul. 11, 2017

(54) DISCHARGING DEVICE

(75) Inventors: Juergen Greiner-Perth, Gottmadingen (DE); Matthias Wochele, Rielasingen-Worblingen (DE); Peter Stadelhofer, Singen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 906 days.

(21) Appl. No.: 12/925,543

(22) Filed: Oct. 22, 2010

(65) Prior Publication Data

US 2011/0095053 A1 Apr. 28, 2011

(30) Foreign Application Priority Data

Oct. 23, 2009 (DE) ..... 10 2009 051 570

(51) Int. Cl.
*B65D 35/56* (2006.01)
*B05B 11/00* (2006.01)

(52) U.S. Cl.
CPC ..... *B05B 11/0043* (2013.01); *B05B 11/0018* (2013.01); *B05B 11/0024* (2013.01);
(Continued)

(58) Field of Classification Search
CPC ..... B95B 11/0043; B95B 11/0018; B95B 11/0024; B95B 11/3026; B95B 11/3932; B95B 11/3035; B95B 11/3047
(Continued)

(56) References Cited

U.S. PATENT DOCUMENTS 3,774,810 A * 11/1973 Corsette ..... 222/146.1
5,197,602 A * 3/1993 Biesecker et al. ..... 206/514
(Continued)

FOREIGN PATENT DOCUMENTS

DE 43 07 752 A1 9/1994
DE 695 02 295 T2 9/1998
(Continued)

OTHER PUBLICATIONS

European Patent Office Search Report dated Nov. 10, 2011 with English translation of Category of Cited Documents (13 pages).
(Continued)

*Primary Examiner* — Lien Ngo
(74) *Attorney, Agent, or Firm* — Flynn, Thiel, Boutell & Tanis, P.C.

(57) ABSTRACT

A discharging device for liquids.
The invention relates to a discharging device for liquids, more particularly for pharmaceutical liquids, comprising a delivery device (10), a liquid storage receptical (20) communicating with an input (10*a*) of the delivery device for storage of the liquid (30), and a discharge orifice (12) which communicates with an outlet (10*b*) of said delivery device, and the liquid storage receptical (20) is at least in part in the form of a dimensionally flexible liquid-containing bag (20) and the liquid storage receptical (20) is disposed in a buffer chamber of constant volume (42).
To prevent air from escaping from the buffer chamber (42), provision is made
- for the buffer chamber to be sealed by a protective housing from the environment (1) in a gas-tight manner,
- for the buffer chamber to communicate with the environment through at least one capillary passageway for the purpose of pressure compensation, or
- for the buffer chamber (42) to communicate with the environment (1) via a balancing passageway for the purpose of pressure compensation, while a valve (70) which opens in dependence on the pressure differential is disposed in this balancing passageway.

12 Claims, 5 Drawing Sheets

(52) U.S. Cl.
CPC ..... *B05B 11/3026* (2013.01); *B05B 11/3032* (2013.01); *B05B 11/3035* (2013.01); *B05B 11/3047* (2013.01)

(58) Field of Classification Search
USPC ... 222/105, 106, 100, 94, 321.7, 321.9, 442; 220/403, 400, 495.04; 215/11.5, 11.3
See application file for complete search history.

(56) References Cited

U.S. PATENT DOCUMENTS

| | | | | |
|---|---|---|---|---|
| 5,277,015 | A * | 1/1994 | Brown et al. | 53/449 |
| 5,505,338 | A * | 4/1996 | Gueret | 222/95 |
| 5,630,531 | A * | 5/1997 | Gaucher | 222/96 |
| 5,813,571 | A * | 9/1998 | Gaucher | 222/95 |
| RE36,410 | E * | 11/1999 | Meshberg | 141/2 |
| 6,021,924 | A * | 2/2000 | Suck et al. | 222/105 |
| 6,042,850 | A * | 3/2000 | Ida et al. | 426/2 |
| 6,223,933 | B1 | 5/2001 | Hochrainer et al. | |
| 6,415,962 | B1 * | 7/2002 | Bougamont et al. | 222/321.7 |
| 7,066,359 | B2 | 6/2006 | Greiner-Perth | |
| 7,090,093 | B2 | 8/2006 | Hochrainer et al. | |
| 7,182,226 | B2 | 2/2007 | Mbonyumuhire | |
| 7,201,296 | B2 | 4/2007 | Graf | |
| 8,167,171 | B2 * | 5/2012 | Moretti | 222/95 |
| 2004/0000567 | A1 | 1/2004 | Greiner-Perth | |
| 2004/0182867 | A1 | 9/2004 | Hochrainer et al. | |
| 2004/0256414 | A1 | 12/2004 | Graf | |
| 2005/0098583 | A1 | 5/2005 | Mbonyumuhire | |
| 2005/0127107 | A1 | 6/2005 | Mbonyumuhire et al. | |
| 2006/0037968 | A1 * | 2/2006 | Brenner | 222/105 |
| 2009/0050651 | A1 | 2/2009 | Auer | |

FOREIGN PATENT DOCUMENTS

| | | |
|---|---|---|
| DE | 198 51 404 A1 | 5/2000 |
| DE | 20 2005 014 895 U1 | 8/2006 |
| EP | 0 696 479 A1 | 2/1996 |
| EP | 1 295 646 A1 | 3/2003 |

OTHER PUBLICATIONS

Examination Report of German Patent Ottice dated Apr. 27, 2010 (3 pages).

* cited by examiner

DISCHARGING DEVICE

FIELD OF APPLICATION AND PRIOR ART

The invention relates to a discharging device for liquids, more particularly for pharmaceutical liquids, which discharging device comprises a delivery device, a liquid storage receptical that communicates with the inlet of the delivery device and is intended for storage of the liquid, and a discharge orifice that communicates with the outlet of the delivery device. The liquid storage receptical is in the form, at least partly, of a dimensionally flexible liquid-containing bag and is disposed in a buffer chamber of constant volume. This application claims the priority of the German patent application No. 10 2009 051 570.4. The whole disclosure of this prior application is herewith incorporated by reference into this application.

Discharging devices for liquids, more particularly for pharmaceutical liquids, are well known in the prior art. They serve, for example, as dispensers for nasal, oral, or other pharmaceutical applications and as dispensers for cosmetic products. Using the delivery device, a user can cause liquid to pass from the liquid storage receptical to the discharge orifice, whence the liquid is discharged, for example, in the form of a spray jet.

In a particularly common design of such a dispenser, the liquid storage receptical has an unalterable interior volume. In order to prevent a negative pressure from developing in this liquid storage receptical as discharges of liquid take place, on account of the unalterable volume of said receptical, provision is made, in most forms of such discharging devices, for air to flow into the liquid storage receptical through a balancing passageway so that the ambient pressure is approximately re-established in the liquid storage receptical.

By contrast, provision is made in generic discharging devices for the liquid storage receptical to be dimensionally flexible and thus capable of altering its interior volume as discharges of liquid take place. There is therefore no requirement for an inflow of air into the liquid storage receptical. It is likewise known to surround this dimensionally flexible liquid storage receptical by a buffer chamber of constant volume so that the dimensionally flexible liquid storage receptical is hidden from the view of the user and there is no fear of any mechanical damage taking place in relation to the liquid storage receptical. However, in such generic discharging devices, a pressure-balancing passageway is usually provided, by means of which the buffer chamber communicates with the environment so that the increase in volume of that region of the buffer chamber that is not occupied by the liquid storage receptical, as occurs as liquid is removed from the liquid storage receptical, can be compensated for by the inflow of air in order to maintain the ambient pressure in the buffer chamber and in the liquid storage receptical.

However, it has been found that the generic construction known per se suffers from the drawback that the thin wall of the dimensionally flexible liquid storage receptical cannot usually prevent liquid from escaping from the liquid storage receptical into the buffer chamber and thus from causing a change in the liquid located in the liquid storage receptical, particularly a change in the concentration of the active ingredient present in the liquid, in the case of pharmaceutical liquids. Since air is largely free to flow between that volume of the buffer chamber that is not occupied by the liquid storage receptical and the environment, the air in the buffer chamber in the generic discharging devices described above never becomes saturated so that the process of liquid diffusing out of the liquid storage receptical to the buffer chamber through the thin wall of the liquid storage receptical progresses and, as such diffusion continues, there is a continuous change in the liquid located in the liquid storage receptical or a decrease in the amount thereof.

The Object and its Solution

It is an object of the invention to design a generic discharging device such that this detrimental diffusion process is prevented or reduced.

In a first variant of the invention, this object is achieved in that the buffer chamber is sealed off in a gas-tight manner from the environment by a protective housing.

In such a design of the discharging device, communication between the environment of the discharging device and that region of the buffer chamber that is not occupied by the liquid storage receptical is eliminated. As a result, liquid can diffuse only to a limited extent through the wall of the liquid storage receptical into the region of the buffer chamber that is not occupied by the liquid storage receptical, but saturation of the air soon occurs in the buffer chamber to terminate this diffusion process. No exchange of air between the buffer chamber and the environment takes place so that the air remains saturated. Thus the maximum amount of liquid lost due to the diffusion through the wall of the liquid storage receptical is very limited.

The protective housing that surrounds the buffer chamber is of constant volume and thus does not experience any noteworthy reduction in volume when the discharging device is used according to specifications and has a considerably thicker wall than the liquid storage receptical due to its dimensional stability, so that diffusion does not take place through the wall of said protective housing.

However, the design of the discharging device according to this first variant also results in a negative pressure developing in the buffer chamber, which negative pressure increases with every operation of the delivery device and every discharge of liquid. In order to prevent this negative pressure from increasing to such an extent that the delivery device can no longer work against the negative pressure, it is regarded as being advantageous when, in the delivered state in which the liquid storage receptical is filled with liquid and ambient pressure prevails in the buffer chamber, the liquid storage receptical occupies a maximum volume of 70%, preferably 50%, of the total internal volume of the buffer chamber. This ensures that the pressure in the buffer chamber does not fall below about 0.3 bar or about 0.5 bar, which negative pressure can normally be overcome by the delivery devices generally used in this field. This maximum proportion of 50% or 70% of the total volume can be achieved, for example, by ensuring that the maximum volume of the liquid storage receptical when completely filled with liquid is equal to only half or about two-thirds of the internal volume of the buffer chamber. Alternatively, a liquid storage receptical that has a larger maximum volume but is only partially filled in the delivered state can be used.

In a second variant of the invention, provision is made for the buffer chamber to communicate with the environment via at least one capillary passageway for the purpose of pressure equalization.

Such a capillary passageway has a thin and elongated form, and one of its ends opens into the buffer chamber and the other end opens into the environment. There thus exists the possibility of equalizing the pressure in the buffer chamber with that of the environment, but the fact that the connection between the buffer chamber and the environment is in the form of a capillary passageway results in the air in the buffer chamber still being saturated with liquid. This air saturation prevents further diffusion of liquid from the liquid storage receptical when the discharging device is not used for some time. A stable gradient of humidity is formed in the capillary passageway.

For the purpose of the present invention, the term "capillary passageway" is understood to mean only passageways having a cross-sectional area of less than 1 $mm^2$. In order to prevent the moisture in the buffer chamber from escaping and to ensure the formation of a stable gradient, it is regarded as being particularly advantageous when the quotient of the length of the capillary passageway divided by the mean cross-sectional area thereof is greater than 300 $mm^{-1}$ and very preferably greater than 1000 $mm^{-1}$. A quotient of at least 2500 $mm^{-1}$ is regarded as being even more advantageous. Thus capillary passageways having a mean cross-sectional area of 0.03 $mm^2$ must, according to the invention, have a length of at least about 10 mm.

Over and above the ratio of cross-sectional area to length, it has been found to be particularly advantageous when the cross-sectional area is very small, preferably smaller than 0.05 $mm^2$, more preferably smaller than 0.02 $mm^2$ and in the ideal case smaller than 0.01 $mm^2$. Furthermore, it has been found that the length of the capillary passageway should preferably be at least 10 mm, more preferably at least 30 mm and most preferably at least 50 mm.

It is particularly advantageous when the capillary passageway is in the form, at least partly, of a groove-like recess in an outside surface of the liquid storage receptical or in an inside surface of the protective housing. Such a groove-like recess is easy to produce. The capillary passageway can then be circumferentially closed by causing the outside surface of the liquid storage receptical or the inside surface of the protective housing to bear against a respective counterelement. It is particularly advantageous when the capillary passageway in the region formed by the groove-like recess is circumferentially closed jointly by the protective housing on the one hand and the liquid storage receptical on the other. This results in a cost-effective and simple construction. Additionally, the flexible material used for the liquid storage receptical is particularly suitable for providing the capillary passageway with a circumferential seal. A surface of the liquid storage receptical that does not come into contact with the liquid stored in the liquid storage receptical in accordance with its intended use is regarded as being the outside surface of the liquid storage receptical. The region in which the capillary passageway is formed in the outside surface of the liquid storage receptical preferably has a greater wall thickness than that portion of the liquid storage receptical that is deformed in accordance with the intended use of the discharging device.

In order to achieve a particularly long capillary passageway, it is regarded as being advantageous when the groove-like recess extends, at least partly, as an arc or spiral on the outside surface of the liquid storage receptical or on the inside surface of the protective housing. Such a design makes it possible to easily create capillary passageways having a length of more than 50 mm even in small discharging devices having a diameter of less than 20 mm, for example.

In a third variant of the invention that can also be combined with the features of the second variant described above, provision is made for connecting the buffer chamber in a generic discharging device to the environment by means of a pressure-balancing passageway for the purpose of pressure equalization, a valve that opens in dependence on the pressure difference being disposed in this balancing passageway.

In such a design, the balancing passageway need not have a specific length. It serves merely to accommodate the valve that is adapted to open when a negative pressure develops in the buffer chamber in relation to the ambient pressure in the environment. The valve can be designed, for example, to open when a pressure difference of at least 0.1 bar, particularly at least 0.2 bar occurs. The valve can alternatively be adapted to open even when a very slight negative pressure occurs in the buffer chamber.

Such a design likewise ensures that the saturated air inside the buffer chamber cannot escape to the environment. Since the valve opens only when a negative pressure occurs, air can only then flow in and this air results in further diffusion of liquid from the liquid storage receptical into the surrounding buffer chamber only to a small extent. The saturated air does not escape to the environment.

Valves opening in dependence on the pressure difference can be any of the valves suitable for this purpose, for example, valves comprising a seat and a spring-biased body that is movable relatively thereto or alternatively simple diaphragm valves comprising a slotted diaphragm, particularly a diaphragm having a slotted dome.

A design in which the valve has a closing portion that is integrally molded on the liquid storage receptical, is regarded as being particularly advantageous. This closing portion switches from a closed position to an open position due to the dimensionally flexible nature of the material of the liquid storage receptical. Preferably, the closing portion rests against an inside surface of the protective housing in the closed state of the valve. This design, in which the closing portion of the valve is formed by an integrally molded component of the wall of the liquid storage receptical, is particularly cost-effective, since no additional components, apart from the protective housing and the liquid storage receptical, are required for constructing the valve. It is particularly advantageous in this context when the closing portion extends around the circumference of the liquid storage receptical on the outside surface thereof and likewise rests circumferentially against the inside surface of the protective housing.

As mentioned above, the wall of the protective housing is thicker than that of the liquid storage receptical so that a diffusion of liquid through this wall takes place either to an insignificant extent or not at all. In order to further reduce the tendency to diffusion, it can be advantageous to provide the protective housing, at least partly, with a wall made of a material displaying a low rate of diffusion, particularly metal, ceramics, or glass.

Furthermore, it is regarded as being advantageous when a fin oriented outwardly in the radial direction is provided on the liquid storage receptical in the form of a liquid-containing bag, which fin is configured in the form of a seal between the protective housing and an encasement for accommodating the delivery device and disposed separately from the protective housing. As a seal, this fin then performs a dual function. Firstly, it seals that portion of the buffer chamber that is not occupied by the liquid storage receptical relatively to the environment. Secondly, it forms a seal in the region of transition between the liquid storage receptical and the delivery device relative to the environment. In the second and third variants of the invention, provision can be made for the fin to be interrupted by the capillary passageway or the pressure-balancing passageway and for the fin to perform the sealing function only in the regions located apart from said interruption.

BRIEF DESCRIPTION OF THE DRAWINGS

Additional aspects and advantages of the invention are revealed by the claims and the following description of preferred exemplary embodiments of the invention that are explained below with reference to the figures, in which:

DETAILED DESCRIPTION OF THE EXEMPLARY EMBODIMENTS

Figure 1A:
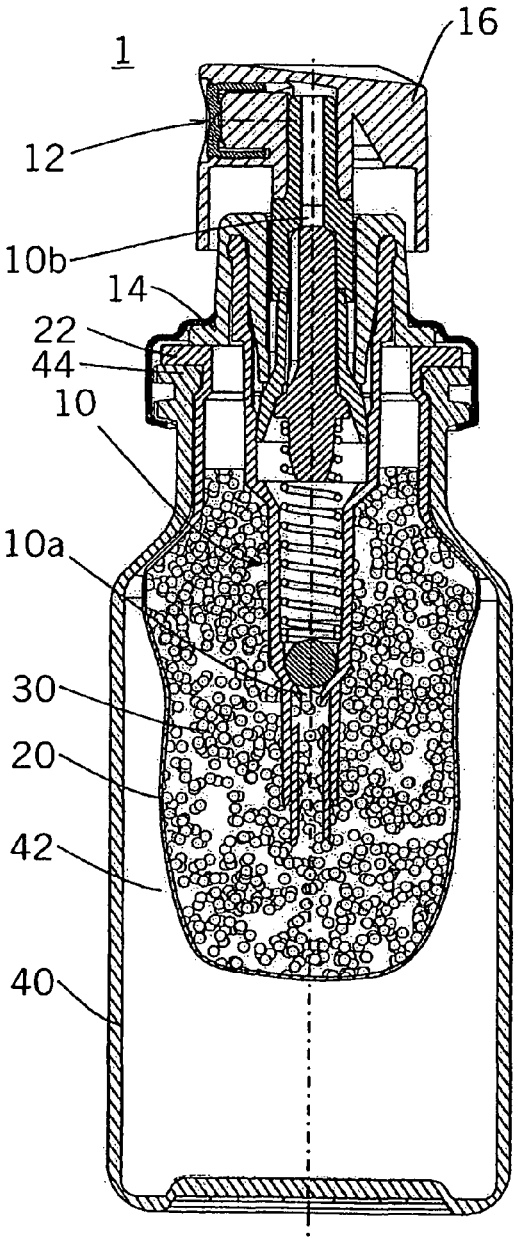
FIGS. 1*a* and 1*b* show a first embodiment of a discharging device of the invention.

The discharging devices of the invention shown in the figures are each in the form of portable discharging devices and they each comprise, as common characteristics, a manually operable delivery device 10, the inlet side 10*a* of which is connected to a liquid storage receptical 20 and the outlet side 10*b* of which is connected to a discharge orifice 12. In the case of the embodiment shown in FIGS. 1 to 3, the delivery device 10 is in the form of a piston pump. In the case of the embodiments shown in FIGS. 4 to 7, the delivery device 10 is in the form of a bellows pump. Furthermore, all embodiments are equivalent to the effect that the liquid storage receptical 20 is in the form of a liquid-containing bag of a flexible nature so that its internal volume can be adapted to suit the amount of liquid 30 that is present in the liquid storage receptical 20 and that is to be discharged. Furthermore, the common feature of the discharging devices of all of the embodiments is that the bag-type liquid storage receptical 20 is disposed in a buffer chamber 42 formed by a protective housing 40 and thus protected from external mechanical influences.

EMBODIMENTS IN DETAIL

FIG. 1*a* shows the first embodiment in the delivered state. In this delivered state, the liquid storage receptical 20 has a maximum volume that is such that the liquid storage receptical 20 fills only about 50% of the buffer chamber 42. In this delivered state, that portion 42*a* of the buffer chamber 42 that is not occupied by the liquid storage receptical is filled with air under approximately ambient pressure (1 bar).

In this and all other embodiments, the liquid storage receptical 20 is only connected to the delivery device 10 such that the liquid 30 present in the liquid storage receptical 20 can escape, at least in liquid form, from the liquid storage receptical 20 only in the direction of the delivery device 10. In the embodiment shown in FIGS. 1*a* and 1*b* and likewise in all of the embodiments illustrated, there is no possibility for ambient air in an environment 1 to enter the liquid storage receptical 20 itself. The liquid storage receptical 20 is sealed off from the environment by means of a circumferential collar 22 provided at the upper end of the liquid storage receptical 20 and clamped between an upper edge 44 of the receptical 40 and a delivery housing 14 to act as a seal.

Figure 1B:
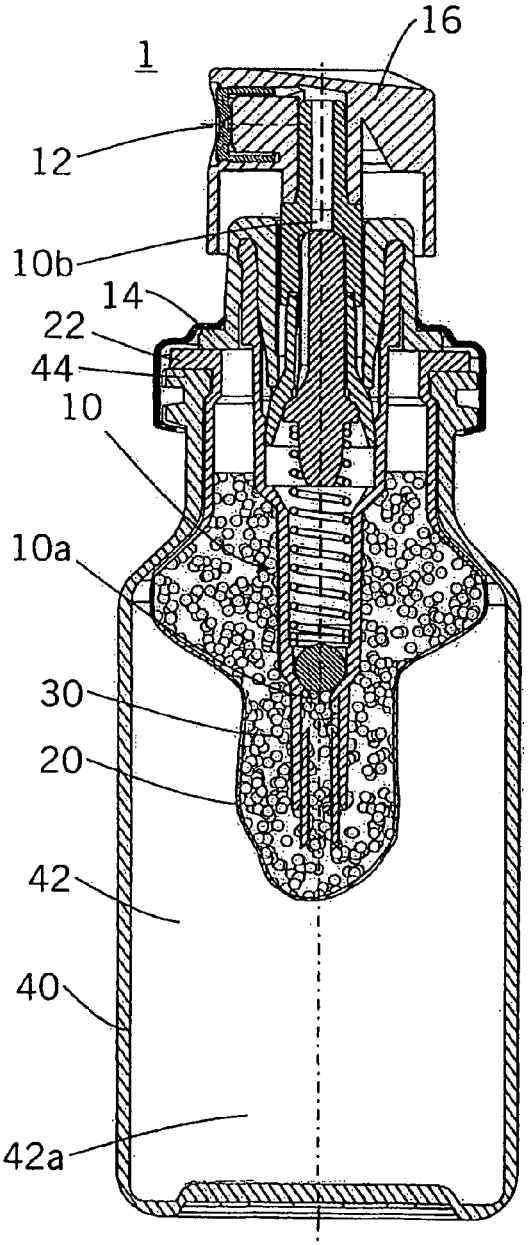

Furthermore, in the embodiment shown in FIGS. 1*a* and 1*b*, this seal also causes that portion 42*a* of the buffer chamber 42 that is filled with air to be sealed off in a gas-tight manner relatively to the environment 1 so that external air can enter neither the liquid storage receptical 20 nor that portion 42*a* of the buffer chamber 42 that is not occupied by the liquid storage receptical 20.

When the discharging device shown in FIGS. 1*a* and 1*b* is put into action in that liquid 30 is discharged by manually operating the delivery device 10 by means of the manual actuator 16, the internal volume of the liquid storage receptical 20 is reduced while the surrounding portion 42*a* of the buffer chamber 42 is necessarily increased. Since no air can flow into the discharging device, this gradually results in a reduction of the pressure prevailing in the buffer chamber 42. This pressure decrease is of only small significance due to the fact that a considerable amount of air is already present in the buffer chamber 42 in the delivered state shown in FIG. 1*a*. When the liquid storage receptical 20 is completely empty, the pressure in the buffer chamber is about 0.5 bar. Since the delivery device 10 is designed such that it can work while counteracting such a low pressure, the operational reliability of the discharging device is always assured.

FIG. 1*b* shows an intermediate state in which half of the liquid 30 has been discharged and the pressure in the buffer chamber 42 is about 0.8 bar, that is, a vacuum of about 0.2 bar prevails relative to the environment.

As a result of the complete isolation of the buffer chamber 42 relative to the environment 1, the design shown in FIGS. 1*a* and 1*b* allows only small amounts of the liquid 30 to diffuse through the wall of the liquid storage receptical 20 into the region 42*a* of the buffer chamber 42. The air in the portion 42*a* very rapidly becomes saturated so that this diffusion process ceases. Since the saturated air cannot escape due to the fact that the buffer chamber 42 is sealed off in a gas-tight manner from the environment 1, only a small amount of liquid 30 can pass into the region 42*a* of the buffer chamber 42.

Figure 3:
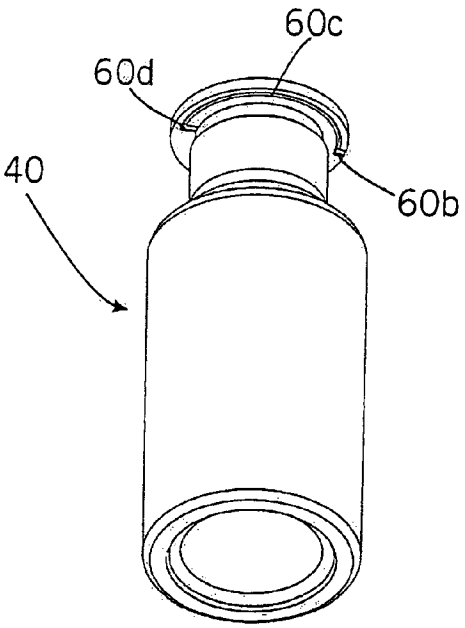
FIGS. 2*a*, 2*b*, and 3 show a second embodiment of a discharging device of the invention.
Figure 2B:
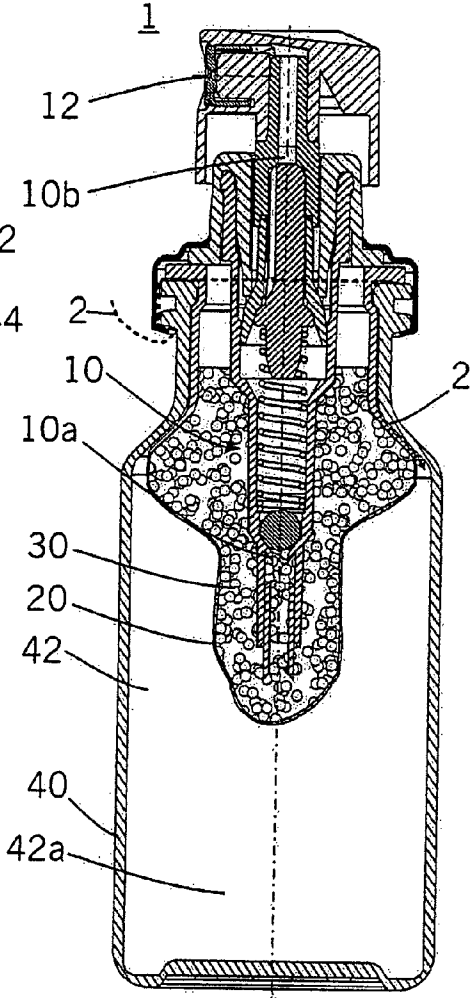
Figure 2A:
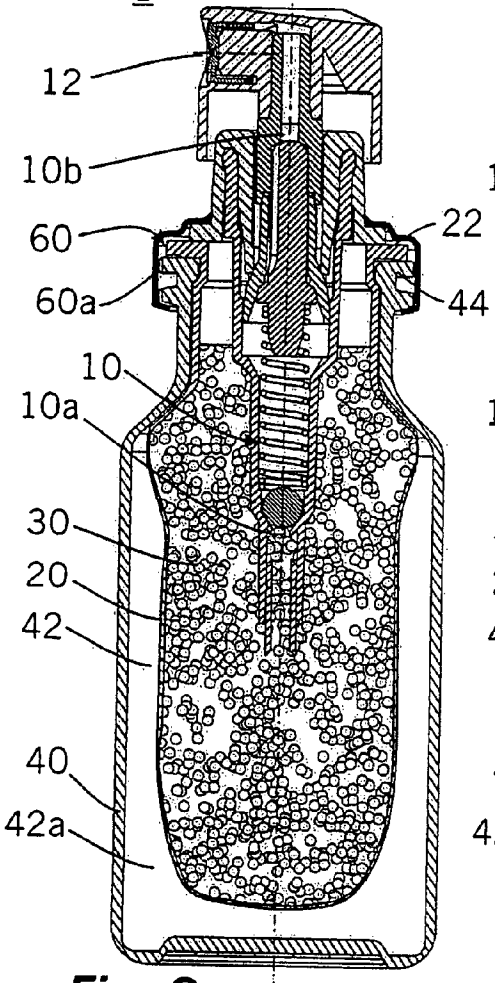

The embodiment shown in FIGS. 2*a* and 2*b* is much the same as the embodiment shown in FIGS. 1*a* and 1*b*. However, this embodiment differs from the first embodiment in that a capillary passageway 60 is provided, a portion 60*a* of which extends from the environment 1 to the collar 22 of the liquid storage receptical 20. As shown in FIG. 3, a groove is provided in this collar 22, to form an outwardly oriented portion 60*b*, a tangentially extending portion 60*c* and a radially inwardly oriented portion 60*d* of the capillary passageway 60. The open side of this groove is closed by the upper edge 44 of the receptical 40. Air can enter the region 42*a* of the buffer chamber 42 through the capillary passageway so that pressure equalization can take place as the liquid storage receptical 20 is progressively emptied. The ambient pressure of about 1 bar is thus re-established in the buffer chamber 42 shortly after each operation of the discharging device. The path of the air through the capillary passageway 60 is illustrated by the dotted arrow 2 shown in FIG. 2*b*.

Thus in this embodiment shown in FIGS. 2*a*, 2*b*, and 3, there is communication between the environment 1 and the buffer chamber 42. However, since this communication takes the form of a capillary passageway 60, it does not allow the liquid that has diffused from the liquid storage receptical 20 into that region 42*a* of the buffer chamber 42 that is not occupied by the liquid storage receptical 20 to escape into the environment 1. Instead, a stable gradient is established in the capillary passageway 60 between the saturated air in the region 42*a* and the air in the environment 1, which gradient allows the liquid 30 that has diffused from the liquid storage receptical 20 to escape from the portion 42*a* of the buffer chamber 42 in negligible amounts only.

Figure 4A:
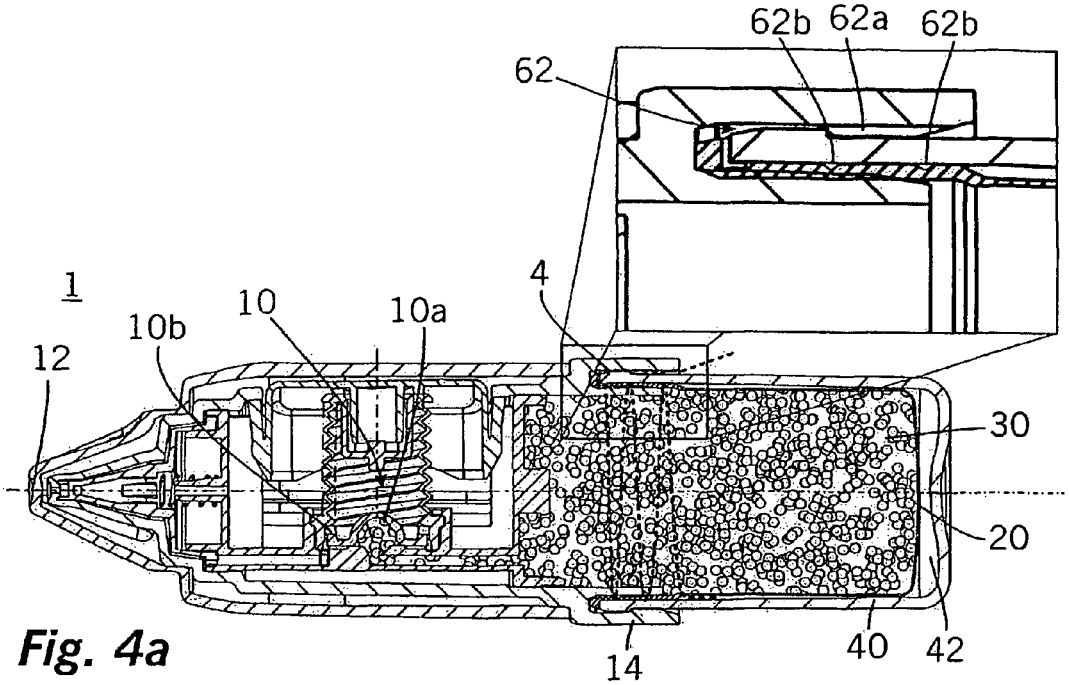
FIGS. 4*a*, 4*b*, and 5 show a third embodiment of a discharging device of the invention.
Figure 4B:
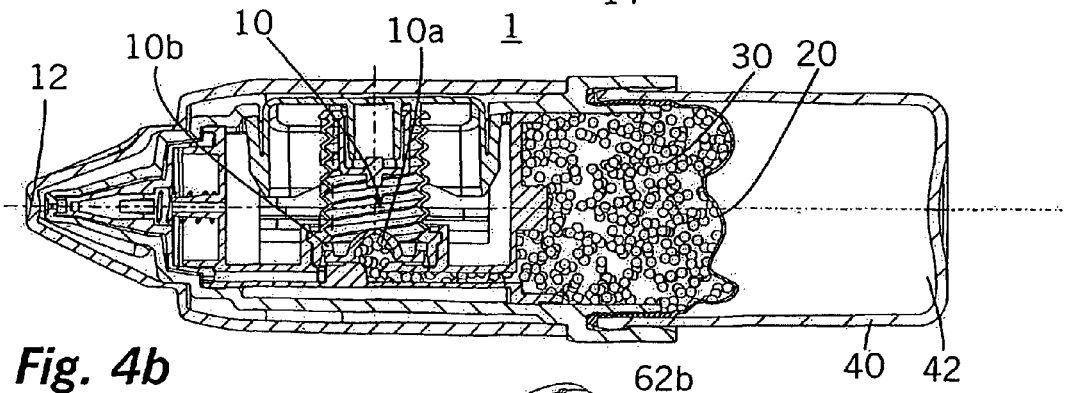
Figure 5:
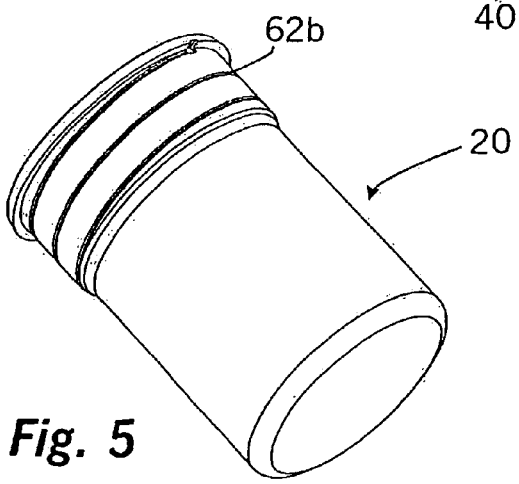

The embodiment shown in FIGS. 4 and 5 illustrates a dispenser that differs decidedly from the preceding embodiments in terms of the basic construction and yet follows a similar basic principle with regard to the aeration of that region 42*a* of the buffer chamber 42 that is not occupied by the liquid storage receptical 20. Here again, a capillary passageway 62 is provided, the first segment 62*a* of which extends between two housing portions 14 and 40. The segment 62*a* adjoins a segment 62*b* of the capillary passageway, which is in the form of a spiral groove in the external surface of the liquid storage receptical 20 and the open side of which is closed by the inside surface of the protective housing 40.

The purpose of this capillary passageway 62 is the same as that of the capillary passageway 60 of the embodiment shown in FIGS. 2*a*, 2*b*, and 3. The air from the environment 1 can enter the buffer chamber 42 along the path of the dotted arrow 4. The distinctive feature of this embodiment consists particularly in the increased length of the capillary passageway 62 as a result of its spiral shape.

Figure 6A:
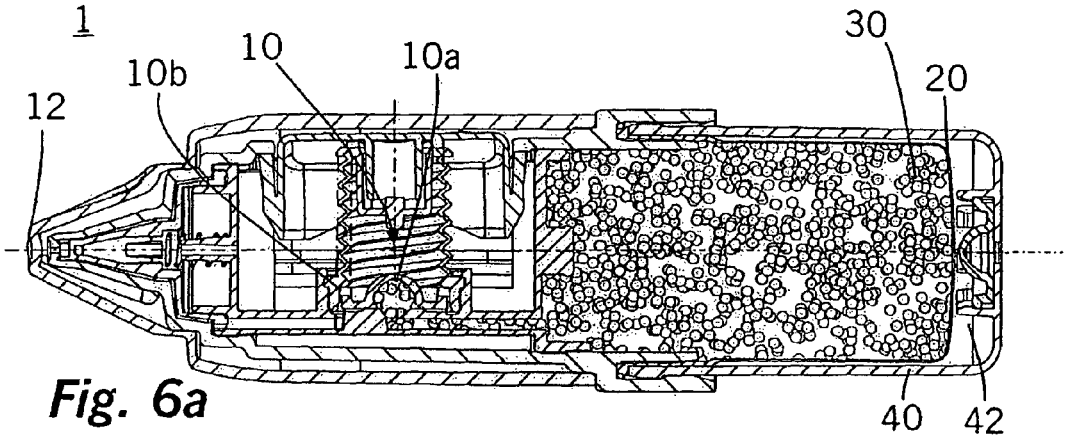
FIGS. 6*a* and 6*b* show a fourth embodiment of a discharging device of the invention.
Figure 6B:
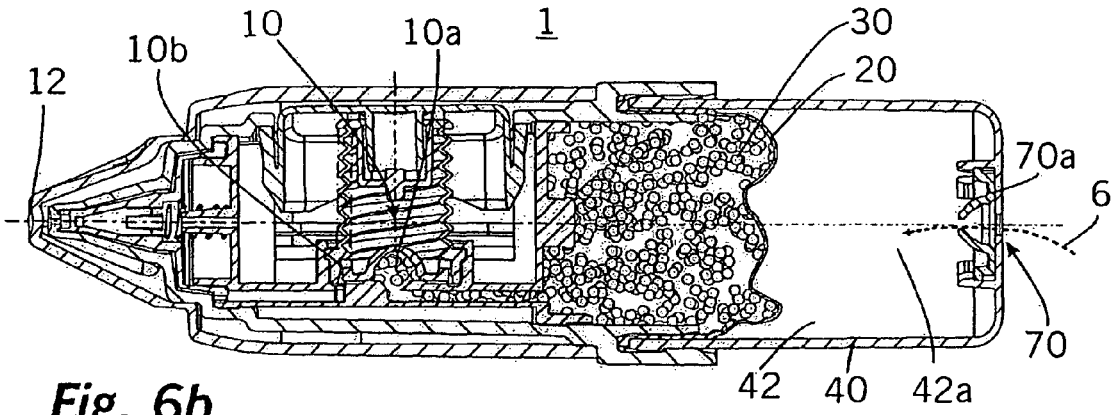

In the embodiment shown in FIGS. 6*a* and 6*b*, provision is again made for the decrease in volume of the liquid storage receptical 20 caused by the discharges of the liquid 30 to be compensated for a subsequent flow of air into that portion 42*a* of the buffer chamber 42 that is not occupied by the liquid storage receptical 20. However, this is achieved, not by a capillary passageway, but instead by a valve 70 which opens in dependence on the prevailing pressure. The valve comprises a dome-shaped valve diaphragm 70*a* that is slotted in its domed region. When the volume of the liquid storage receptical 20 decreases due to the discharge of liquid, a negative pressure develops in the region 42*a* in relation to the environment 1. When the pressure difference between the air in the region 42*a* and the environment 1 exceeds 0.2 bar, the valve 70 opens in the manner shown in FIG. 6*b* and permits an inflow of air along the path of the arrow 6. However, the liquid that diffuses through the wall of the liquid storage receptical 20 into the region 42*a* to cause saturation of the air in this region cannot escape from the buffer chamber 42 so that, in this embodiment also, only a small amount of liquid 30 will be lost to the environment 1.

Figure 7A:
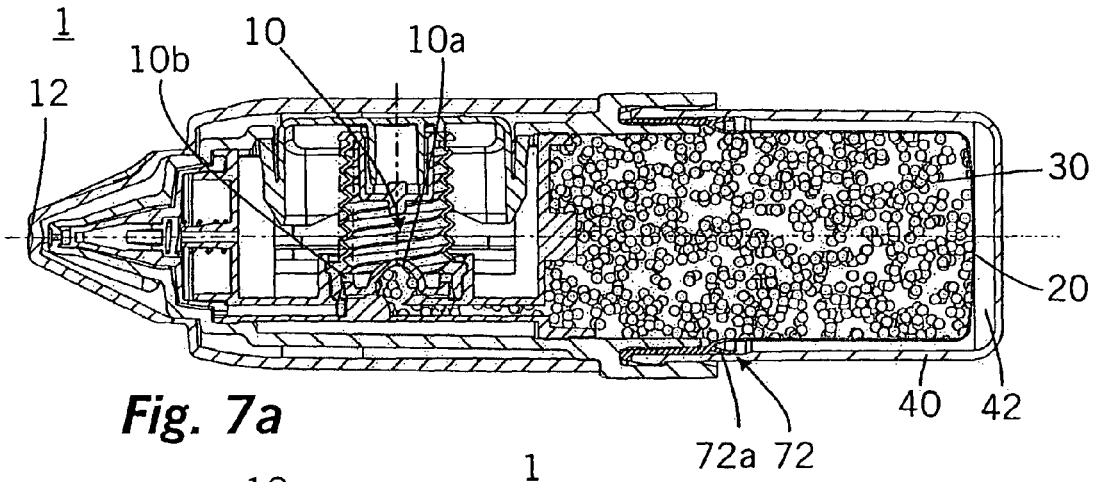
FIGS. 7*a*, 7*b*, and 8 show a fifth embodiment of a discharging device of the invention.
Figure 7B:
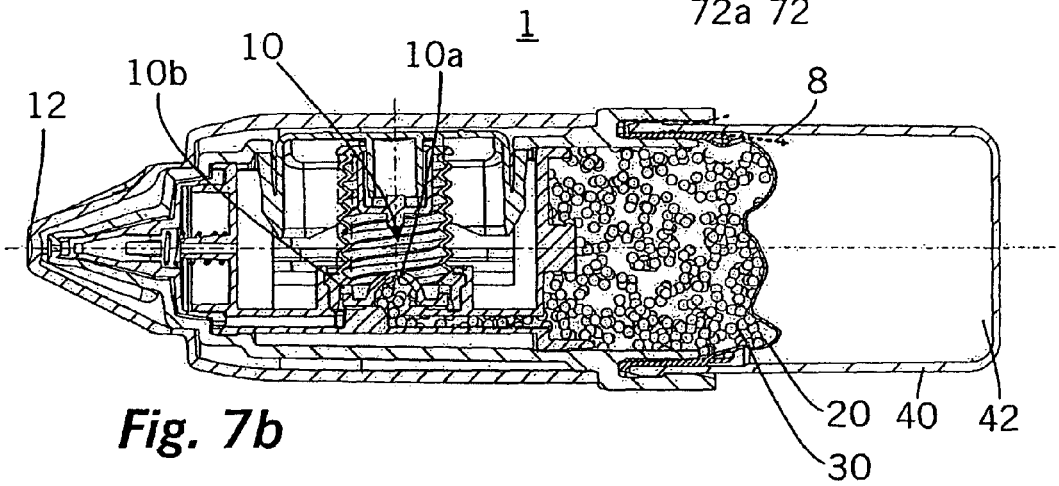
Figure 8:
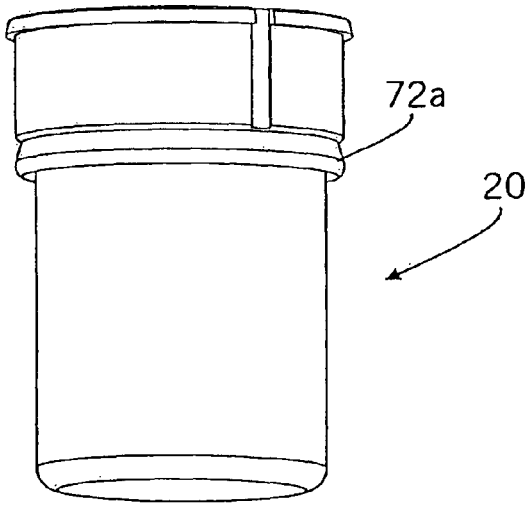

The embodiment shown in FIGS. 7*a*, 7*b* and 8 is closely related to the one shown in FIGS. 6*a* and 6*b* in terms of its mode of operation. However, in this last embodiment, the valve 72 is not formed by a separate diaphragm but by a closing lip 72*a* extending around the circumference of the liquid storage receptical 20 on the outside surface thereof. This closing lip 72*a* rests against an inside surface of the receptical protective housing 40 when the pressure difference between the buffer chamber 42 and the environment 1 is less than 0.2 bar so that no air can escape from the region 42. This is shown in FIG. 7*a*. Only when a negative pressure of more than 0.2 bar is created in the region 42*a* due to of the discharge of liquid 30 from the liquid storage receptical 20, the closing lip 72*a* temporarily moves away, at least partly, from the inside surface protective housing 40 of the receptical and thus makes way for the inflow of air that travels along path indicated by the arrow 8, i.e. from the environment 1 to the region 42*a* of the buffer chamber 40.

The invention claimed is:

1. A discharging device for liquids, comprising:

a delivery device, an outer housing defining a buffer chamber, a liquid storage receptacle that communicates with an inlet of said delivery device and is adapted to store liquid, and a discharge orifice communicating with an outlet of said delivery device, wherein said liquid storage receptacle is at least in part in the form of a dimensionally flexible liquid-containing bag, and said liquid storage receptacle is disposed in the buffer chamber of constant volume, wherein said buffer chamber permanently communicates with the environment through at least one capillary passageway for the purpose of balancing the pressure, the capillary passageway being configured such that air in the buffer chamber remains saturated with liquid, the capillary passageway having a length-divided-by-average-cross-sectional-area quotient greater than 1000 $mm^{-1}$, and is, at least in part, a groove defined between a portion of the liquid storage receptacle and a portion of the outer housing.

2. The discharging device according to claim 1, wherein said capillary passageway has an elongated, narrow form, and the average cross-sectional area of said capillary passageway is less than 0.05 $mm^2$.

3. The discharging device according to claim 1, wherein said capillary passageway is in a region jointly sealed off by a protective housing and said liquid storage receptacle.

4. The discharging device according to claim 1, wherein said groove extends at least in part in the form of an arc or spiral on the external surface of said liquid storage receptacle.

5. The discharging device according to claim 1, wherein said buffer chamber is delimited relative to the environment by a wall made of a material displaying a low diffusion rate.

6. The discharging device according to claim 1, wherein on said liquid storage receptacle a radially outwardly oriented fin is provided, which performs the function of a gasket between said buffer chamber and a housing part containing said delivery device.

7. The discharging device according to claim 2, wherein the average cross-sectional area of said capillary passageway is less than 0.02 $mm^2$.

8. The discharging device according to claim 7, wherein the average cross-sectional area of said capillary passageway is less than 0.01 $mm^2$.

9. The discharging device according to claim 1, wherein the length of the capillary passageway is greater than 10 mm.

10. The discharging device according to claim 9, wherein the length of the capillary passageway is greater than 30 mm.

11. The discharging device according to claim 10, wherein the length of the capillary passageway is greater than 50 mm.

12. The discharging device according to claim 5, wherein the material of the wall comprises at least one of metal, ceramic, and glass.

* * * * *